US007383705B2

(12) United States Patent
Okamoto

(10) Patent No.: US 7,383,705 B2
(45) Date of Patent: Jun. 10, 2008

(54) METHOD OF KNITTING TUBULAR KNITTED FABRIC

(75) Inventor: Kazuyoshi Okamoto, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 11/794,390

(22) PCT Filed: Dec. 26, 2005

(86) PCT No.: PCT/JP2005/023819

§ 371 (c)(1),
(2), (4) Date: Jun. 28, 2007

(87) PCT Pub. No.: WO2006/070764

PCT Pub. Date: Jul. 6, 2006

(65) Prior Publication Data

US 2008/0016918 A1 Jan. 24, 2008

(30) Foreign Application Priority Data

Dec. 28, 2004 (JP) ..... 2004-381830

(51) Int. Cl.
*D04B 7/10* (2006.01)

(52) U.S. Cl. ..... 66/70; 66/170

(58) Field of Classification Search ..... 66/64, 66/70, 170, 176, 76
See application file for complete search history.

(56) References Cited

U.S. PATENT DOCUMENTS 3,167,938 A * 2/1965 Seiler ..... 66/70
3,668,896 A * 6/1972 Betts et al. ..... 66/70
5,692,399 A 12/1997 Takahashi et al.
6,176,105 B1 * 1/2001 Chan et al. ..... 66/70

FOREIGN PATENT DOCUMENTS

JP 05-009851 1/1993
JP 7-81228 8/1995

* cited by examiner

*Primary Examiner*—Danny Worrell
(74) *Attorney, Agent, or Firm*—Harness, Dickey & Pierce, P.L.C.

(57) ABSTRACT

When knitting a tubular knitted fabric having a difference in the number of wales between a front knitted fabric and a back knitted fabric, knitted fabrics are knitted alternately while turning the tubular knitted fabric and jointing the front section having a large number of wales at middle portions. In one example embodiment, turning is performed such that one boundary of boundaries coupling the fabrics is positioned between front and back needle beds. The numbers of wales of the fabrics caught on the needle beds on both sides are equalized and the fabric of the front section having a large number of wales is knitted from one boundary to the joints at a middle portion of the knitting width. Subsequently, the tubular fabric is turned such that the other boundary is positioned between the needle beds, and the fabric is knitted from the boundary of the front section to the joints and then coupled.

10 Claims, 6 Drawing Sheets

METHOD OF KNITTING TUBULAR KNITTED FABRIC

TECHNICAL FIELD

The present invention relates to a method of knitting a tubular knitted fabric in order to seamlessly produce clothing and the like that fit the body shape of a person with a flat knitting machine.

BACKGROUND ART

It is conventionally known that in a flat knitting machine provided with a pair of front and back needle beds, a tubular knitted fabric having front and back knitted fabrics that are continuously formed at both ends can be knitted by feeding a yarn alternately to knitting needles on the front and back needle beds so as to carrying out round-knitting. As a tubular knitted fabric, clothing and the like worn on the body can be seamlessly knitted. Herein, it is necessary to prevent mutually opposing knitting needles that catch the knitted fabrics on the respective needle beds from moving away from each other, at a knitting end portion at which knitted fabrics knitted on the front and back needle beds are continuously formed. When mutually opposing knitting needles that catch the knitting ends move away from each other, the continuous portion is stretched, and thus stitches become coarse, causing the problem that the external appearance as a product is marred or that the continuous portion is broken during knitting.

The body that wears the clothing has a shape in which the breast portion is larger than the back portion in the upper body, for example, and thus it is preferable to increase the number of wales on the side worn on the breast portion. In a case where clothing in which the number of wales is different between front and back knitted fabrics in this manner is knitted with a flat knitting machine as a seamless tubular knitted fabric, it is conceivable to knit the knitted fabrics at an equivalent knitting width on the front and back needle beds by shifting the knitted fabric having a larger number of wales to the needle bed allocated for the knitting of the knitted fabric having a smaller number of wales. Herein, a part of the knitted fabric having a larger number of wales is knitted, not on the needle bed originally allocated for the knitting of stitches thereof, but on the needle bed opposed to this needle bed. For example, in a case where the number of wales is larger in a knitted fabric that is knitted on the front needle bed, when a stitch knitted on the front needle bed is turned onto the back needle bed, the stitch is twisted. When a stitch is formed on that stitch, the stitch is fixed as a twisted stitch. When a stitch is a twisted stitch, there is the problem that the external appearance is marred. The present applicant has disclosed a technique for preventing a twisted stitch in this case, as a tubular knitted fabric having a three-dimensional silhouette and a method of knitting the same (see Japanese Unexamined Patent Publication JP-A 5-9851 (1993), for example). According to this technique, a stitch that is to be turned onto the back needle bed is formed so as to be twisted in advance on the front needle bed. The twist of the stitch that has been formed to as to be twisted in advance is cancelled when the stitch is turned onto the back needle bed, thus there is no problem in forming a stitch on that stitch.

In a case where clothing worn on the body is knitted as a tubular knitted fabric and the tubular knitted fabric is constricted by forming a dart, conventionally, the same dart is formed in the front section and the back section, so that there is no difference in the number of wales between the knitted fabrics of the front section and the back section that are knitted on the front and back needle beds. Such a tubular knitted fabric does not completely fit an asymmetric body.

According to the method disclosed in JP-A 5-9851, while forming a three-dimensional silhouette by increasing or decreasing the number of wales in one of front and back knitted fabrics in a tubular knitted fabric, it is possible to obtain an equivalent knitting width for knitted fabrics caught on front and back needle beds, and to prevent formation of a twisted stitch. However, in order to prevent formation of a twisted stitch, it is necessary to form a reversely twisted stitch in advance on a needle bed on the opposite side, so that the twist is cancelled as the stitch is shifted between needle beds. Thus, this method takes extra effort.

DISCLOSURE OF INVENTION

It is an object of the invention to provide a method of knitting a tubular knitted fabric, which enables to carry out asymmetrical knitting in a condition to different numbers of wales between front and back knitted fabrics efficiently without formation of a twisted stitch.

The invention provides a method of knitting a tubular knitted fabric using a flat knitting machine provided with at least a pair of front and back needle beds such that a front knitted fabric belonging to the front needle bed and a back knitted fabric belonging to the back needle bed are continuously formed on both sides in a knitting width and such that the number of wales is different between the front knitted fabric and the back knitted fabric, comprising:

a step on one side of carrying out turning such that the knitted fabrics caught on the needle beds on both sides have an equivalent number of wales, in which between continuous portions between a knitted fabric having a larger number of wales and a knitted fabric having a smaller number of wales, the continuous portion on one side in the knitting width is positioned between the pair of front and back needle beds, the needle bed to which the knitted fabric having a smaller number of wales belongs catches the knitted fabric having a smaller number of wales, the continuous portion on the other side, and an end portion of the knitted fabric having a larger number of wales, and the needle bed to which the knitted fabric having a larger number of wales belongs catches the knitted fabric having a larger number of wales except for the end portion; and a step on the other side of carrying out turning such that the knitted fabrics caught on the needle beds on both sides have an equivalent number of wales, in which between the continuous portions between the knitted fabric having a larger number of wales and the knitted fabric having a smaller number of wales, the continuous portion on the other side in the knitting width is positioned between the pair of front and back needle beds, the needle bed to which the knitted fabric having a smaller number of wales belongs catches the knitted fabric having a smaller number of wales, the continuous portion on the one side, and an end portion of the knitted fabric having a larger number of wales, and the needle bed to which the knitted fabric having a larger number of wales belongs catches the knitted fabric having a larger number of wales except for the end portion, wherein the step on the one side and the step on the other side are alternately repeated, the knitted fabric having a larger number of wales is provided with a joint, within a range in which the joint is caught on the knitted fabric having a larger number of wales in both of the step on the one side and the step on the other side, in the step on the one side, in the knitted fabric having a larger number of wales, a portion on the one side from the continuous portion on the one side to the joint is knitted, in the step on the other side, in the knitted fabric having a larger number of wales, a portion on the other side from the continuous portion on the other side to the joint is knitted, and the portion on the one side and the portion on the other side in the knitted fabric having a larger number of wales are linked to each other at the joint.

Furthermore, in the invention, it is preferable that in at least one of the front knitted fabric and the back knitted fabric, a dart is formed in a middle portion in the knitting width by decreasing and then increasing the number of wales in accordance with progress of course knitting.

Furthermore, in the invention, it is preferable that even when the knitted fabric in which the dart is formed is the knitted fabric having a smaller number of wales, the knitted fabric is knitted separately in the step on the one side and the step on the other side, and linking is carried out at the joint, the joint is formed so as to be positioned on the same straight line in a wale direction, and in each of the portion on the one side and the portion on the other side in the knitted fabric, a line in which a narrowing line is continued to a widening line of the dart is formed at the same interval from a line constituted by the joint.

Furthermore, in the invention, it is preferable that in at least one of the front knitted fabric and the back knitted fabric, a swell is formed in a middle portion in the knitting width by increasing and then decreasing the number of wales in accordance with progress of course knitting.

Furthermore, in the invention, it is preferable that in at least one of the front knitted fabric and the back knitted fabric, the number of wales is increased or decreased in accordance with progress of course knitting.

Furthermore, in the invention, it is preferable that the joint provided in the knitted fabric having a larger number of wales is knitted so as to be positioned on the same wale such that the joint is spaced away from the continuous portions between the front knitted fabric and the back knitted fabric, within a range of the knitting width in which the joint is caught on the same needle bed in both of the step on the one side and the step on the other side.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1A:
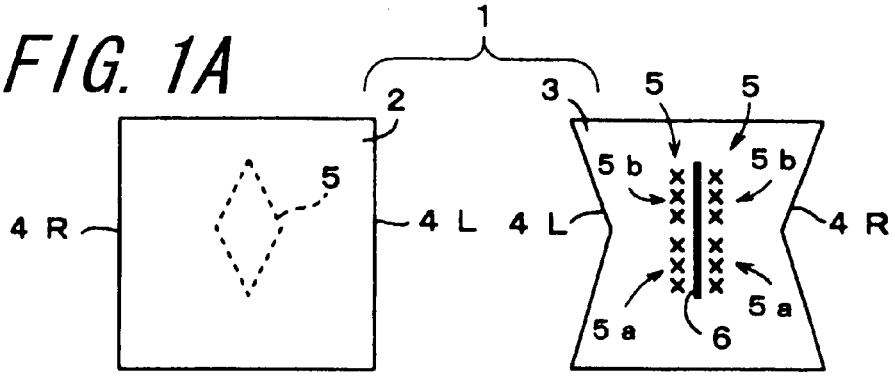
FIGS. 1A to 1F show a schematic shape of a tubular knitted fabric 1 that is knitted in one embodiment of the invention, and the basic manner in which this knitting is carried out.

Now referring to the drawings, preferred embodiments of the invention are described below.

FIGS. 1A to 1F show a schematic shape of a tubular knitted fabric 1 that is knitted in one embodiment of the invention, and the basic manner in which this knitting is carried out. It should be noted that also in FIGS. 2A and 2B and thereafter, the corresponding components are denoted by the same reference numerals, and a description thereof is not repeated.

FIG. 1A shows a front section 2 and a back section 3 of a tubular knitted fabric 1. The front section 2 and the back section 3 are continuously formed at a boundary 4R, which is on the right side when the tubular knitted fabric 1 is worn on the body, and a boundary 4L, which is on the left side. In the front section 2 and the back section 3, stitches serving as face stitches are knitted, for example, respectively on a front needle bed and a back needle bed in a flat knitting machine provided with front and back needle beds. In drawn-off knitting on a pair of front and back needle beds, or knitting in a flat knitting machine provided with two needle beds on each of the front and back sides, various stitches as those knitted in a single knitted fabric that is not tubular, using the front and back needle beds, can be knitted also in a tubular knitted fabric.

In the tubular knitted fabric 1 in FIG. 1A, the vertical direction in which courses are arranged from bottom to top in the drawing is referred to as a course direction, and the horizontal direction in which wales are horizontally arranged in the drawing is referred to as a wale direction. For example, courses are repeatedly knitted from bottom to top. At an upper end and a lower end, there is no difference in the number of courses in each wale between the front section 2 and the back section 3. However, the back section 3 is provided with darts 5 such that a portion with the smallest number of wales is formed in the middle in the vertical direction. With the darts 5, a knitted fabric corresponding to a rhombus as indicated by a broken line in the front section 2 is eliminated from the back section 3. When the portion shown as a rhombus in the front section 2 is eliminated and then portions of the knitted fabric are linked to each other in the center of the rhombus, in the back section 3, the darts 5 are formed as two separate lines, and a narrowing line 5*a* and a widening line 5*b* are formed in each line. A joint line 6 is formed in the center between the two lines. The knitting width defined by the boundaries 4L and 4R on the left and right in the back section 3 is decreased and then increased such that a constricted portion is formed in the middle.

Figure 1B:
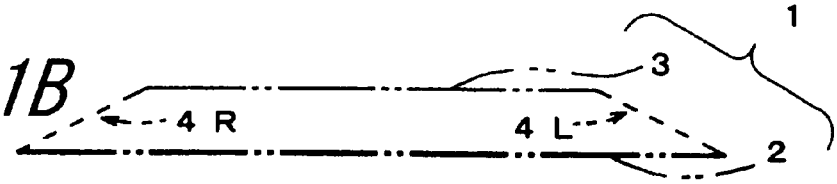

FIGS. 1B to 1E show the basic manner in which the tubular knitted fabric 1 is knitted. In the drawings, the back needle bed is on the upper side, and the front needle bed is on the lower side. Basically, the tubular knitted fabric 1 is knitted using the front and back needle beds such that the front section 2 and the back section 3 are continuously formed at the boundaries 4L and 4R on both sides in the knitting width. The front section 2 belongs to the front needle bed, and is basically knitted on the front needle bed. The back section 3 belongs to the back needle bed, and is basically knitted on the back needle bed. However, a problem is caused when knitting is carried out in a state where the number of wales is different between the front section 2 and the back section 3. For example, as shown in FIG. 1B, when the front section 2 having a larger number of wales and the back section 3 having a smaller number of wales are separately knitted on the front needle bed and the back needle bed, knitting yarns for linking portions that are to be the boundaries 4L and 4R are long, causing the problem that the external appearance of the knitted fabric is marred or that the knitting yarns are extended long to be broken during knitting.

Figure 1C:
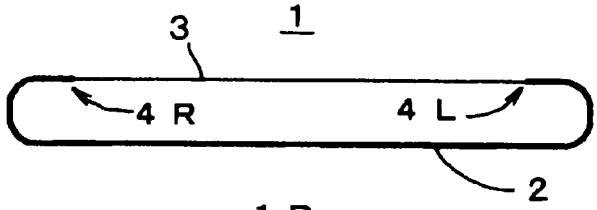
Figure 1D:
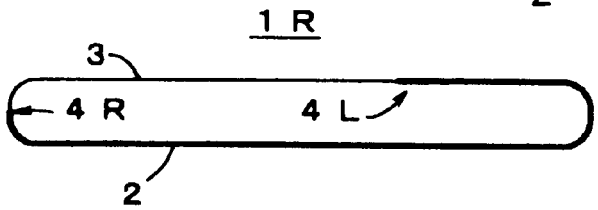
Figure 1E:
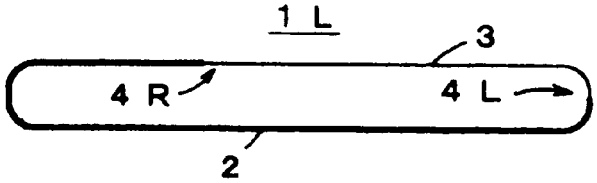

When narrowing is carried out in the back section 3, the difference in the number of wales as shown in FIG. 1B is caused. When stitches knitted on the front needle bed are turned and caught on the back needle bed as shown in FIG. 1C in order to prevent this difference, the stitches are twisted. When knitting is continued in the state shown in FIG. 1C, the stitches that have been twisted are fixed as twisted stitches. FIGS. 1D and 1E show the manner in which knitting is carried out in the invention in order to cancel twisted stitches regardless of any difference in the number of wales. A right portion of the front section 2 is knitted while the knitted fabric is rotated from the state in FIG. 1C to the state in FIG. 1D, and a left portion of the front section 2 is knitted while the knitted fabric is rotated from the state in FIG. 1C to the state in FIG. 1E. This knitting is not round-knitting in the same direction, but knitting in a returning manner in the shape of C, for example. Hereinafter, this knitting is referred to as "C-knitting".

The knitted fabric can be rotated from the state in FIG. 1C to the state in FIG. 1E, by combining transferring and racking between the front and back needle beds. Hereinafter, this rotation is referred to as "turning". When the state in FIG. 1D and the state in FIG. 1E are repeatedly obtained by turning, and the knitted fabric is knitted by C-knitting in each state, the knitting width is decreased and then increased in the back section 3, and thus the darts 5 can be provided. Herein, in FIG. 1D, the tubular knitted fabric in a state where the tubular knitted fabric 1 as shown in FIG. 1C has been turned in order to knit the right portion of the front section 2 is denoted by 1R. In FIG. 1E, the tubular knitted fabric in a state where the tubular knitted fabric 1 as shown in FIG. 1C has been turned in order to knit the left portion of the front section 2 is denoted by 1L.

Figure 1F:
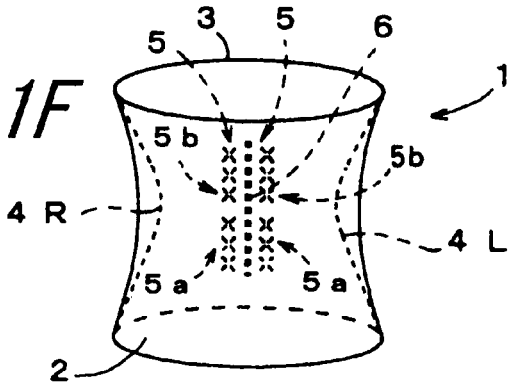

More specifically, the tubular knitted fabric 1 is knitted using a flat knitting machine provided with at least a pair of front and back needle beds such that, for example, the front section 2 and the back section 3 are continuously formed at the boundaries 4L and 4R on both sides in the knitting width, the front section 2 being a front knitted fabric belonging to the front needle bed, and the back section 3 being a back knitted fabric belonging to the back needle bed. When knitting the tubular knitted fabric 1 in which the number of wales is different between the front knitted fabric and the back knitted fabric, a step on one side and a step on the other side are alternately repeated while turning the tubular knitted fabric 1. In the step on one side, as shown in FIG. 1D, between the boundaries 4L and 4R serving as continuous portions between the front section 2 that is a knitted fabric having a larger number of wales and the back section 3 that is a knitted fabric having a smaller number of wales, the boundary 4R serving as the continuous portion on one side in the knitting width is positioned between the pair of front and back needle beds, the needle bed to which the knitted fabric having a smaller number of wales belongs catches the knitted fabric having a smaller number of wales, the boundary 4L serving as the continuous portion on the other side, and an end portion of the knitted fabric having a larger number of wales, and the needle bed to which the knitted fabric having a larger number of wales belongs catches the knitted fabric having a larger number of wales except for that end portion. Accordingly, the knitted fabrics caught on the needle beds on both sides have an equivalent number of wales. Knitting is carried out from the boundary 4R serving as the continuous portion on the one side to a point midway through the knitting width of the front section 2 that is a knitted fabric having a larger number of wales. In the step on the other side, as shown in FIG. 1E, between the boundaries 4L and 4R serving as continuous portions between the front section 2 that is a knitted fabric having a larger number of wales and the back section 3 that is a knitted fabric having a smaller number of wales, the boundary 4L serving as the continuous portion on the other side in the knitting width is positioned between the pair of front and back needle beds, the needle bed to which the knitted fabric having a smaller number of wales belongs catches the knitted fabric having a smaller number of wales, the boundary 4R serving as the continuous portion on the one side, and an end portion of the knitted fabric having a larger number of wales, and the needle bed to which the knitted fabric having a larger number of wales belongs catches the knitted fabric having a larger number of wales except for that end portion. In a state where the knitted fabrics caught on the needle beds on both sides have an equivalent number of wales in this manner, knitting is carried out from the boundary 4L serving as the continuous portion on the other side to the point, knitted in the step on one side, midway through the knitting width of the knitted fabric having a larger number of wales. Then, the knitted fabrics are linkingly joined to each other. In the step on one side and the step on the other side, it is sufficient to knit the knitted fabric up to a midway point on each needle bed, and it is not necessary to carry out an operation for preventing formation of a twisted stitch, by forming a twisted stitch in advance as in JP-A 5-9851. It is possible to efficiently knit the three-dimensional tubular knitted fabric 1 as shown in FIG. 1F, by alternately repeating the step on one side and the step on the other side while turning the knitted fabric.

Figure 2A:
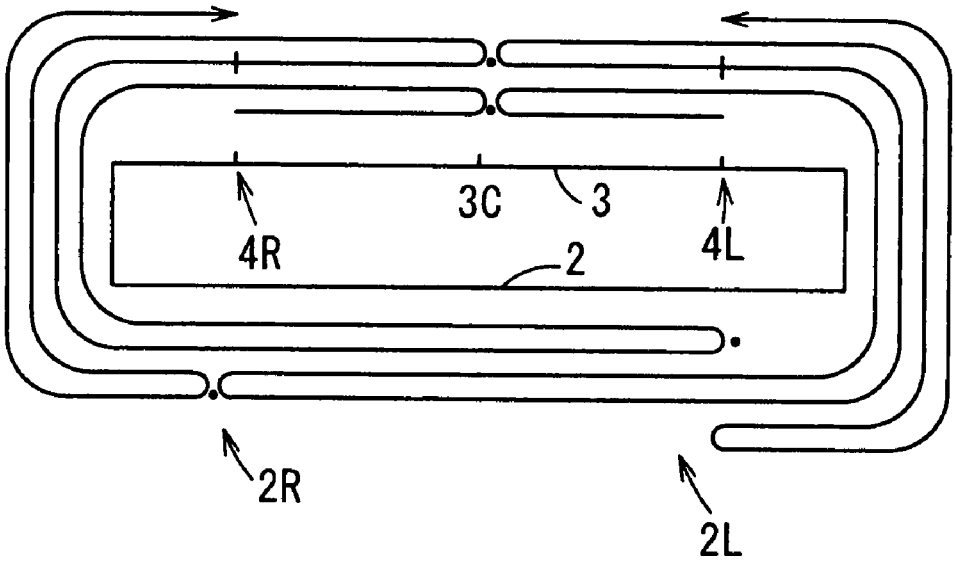
FIGS. 2A and 2B show a state of yarn sending of knitting yarns that are fed to knitting needles when the tubular knitted fabric 1 as shown in FIGS. 1A to 1F is knitted by C-knitting in which a turning direction is repeatedly switched as shown in FIGS. 1D and 1E.
Figure 2B:
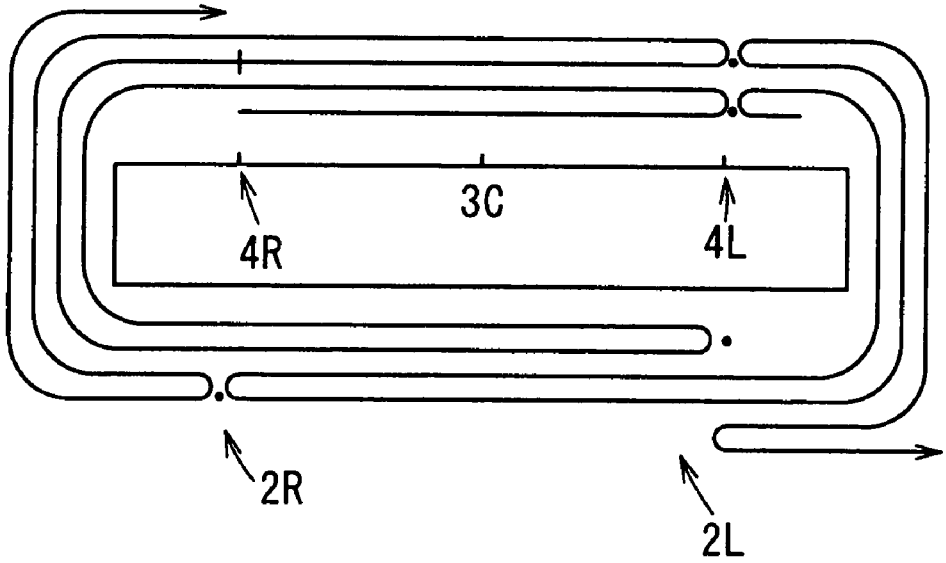

FIGS. 2A and 2B show the state of yarn sending of knitting yarns that are fed to knitting needles when the tubular knitted fabric 1 as shown in FIGS. 1A to 1F is knitted by C-knitting in which the turning direction is repeatedly switched as shown in FIGS. 1D and 1E. The tubular knitted fabric 1 is knitted in such a manner that by using knitting yarns fed from different yarn feeding members, respectively, a portion including the left boundary 4L and a portion including the right boundary 4R are knitted in a returning manner at a joint portion therebetween. FIG. 2A shows an example of yarn sending in which the front section 2 having a larger number of wales is provided with joints 2L and 2R, and the back section 3 having a smaller number of wales is knitted in a returning manner at the center between the darts 5 such that the joint line 6 constituted by a joint 3C is formed along the center between the darts 5 as shown in FIG. 1A. At the joints 2L and 2R, and 3C, stitches are joined to each other by carrying out tucking into the other stitch as in intarsia knitting, for example. Between the knitted fabrics on both sides, both stitches may be tucked into each other, or only one stitch may be tucked into the other. FIG. 2B shows an example of yarn sending in which knitting is carried out between the boundaries 4L and 4R without providing a joint in the back section 3.

When knitting is carried out in a returning manner at the center between the darts 5 also in the back section 3 as shown in FIG. 2A, the joint 3C can be made less noticeable. Since it is not possible to knit the entire front section 2 simultaneously on the front needle bed, it is always necessary to provide the joints 2L and 2R. The joints 2L and 2R are preferably provided at less noticeable positions such as side lines. More specifically, in a knitted fabric having a smaller number of wales, such as the back section 3, the darts 5 are formed in the middle portion in the knitting width by decreasing and then increasing the number of wales in accordance with the progress of course knitting, and thus the knitted fabric can be constricted at the portion of the darts 5. In a knitted fabric in which the darts 5 are formed, such as the back section 3, a position at which linking is carried out midway through the knitting width is provided as the joint line 6 in the center between the darts 5, and thus the joint 3C of the knitted fabric can be made less noticeable.

Figure 3:
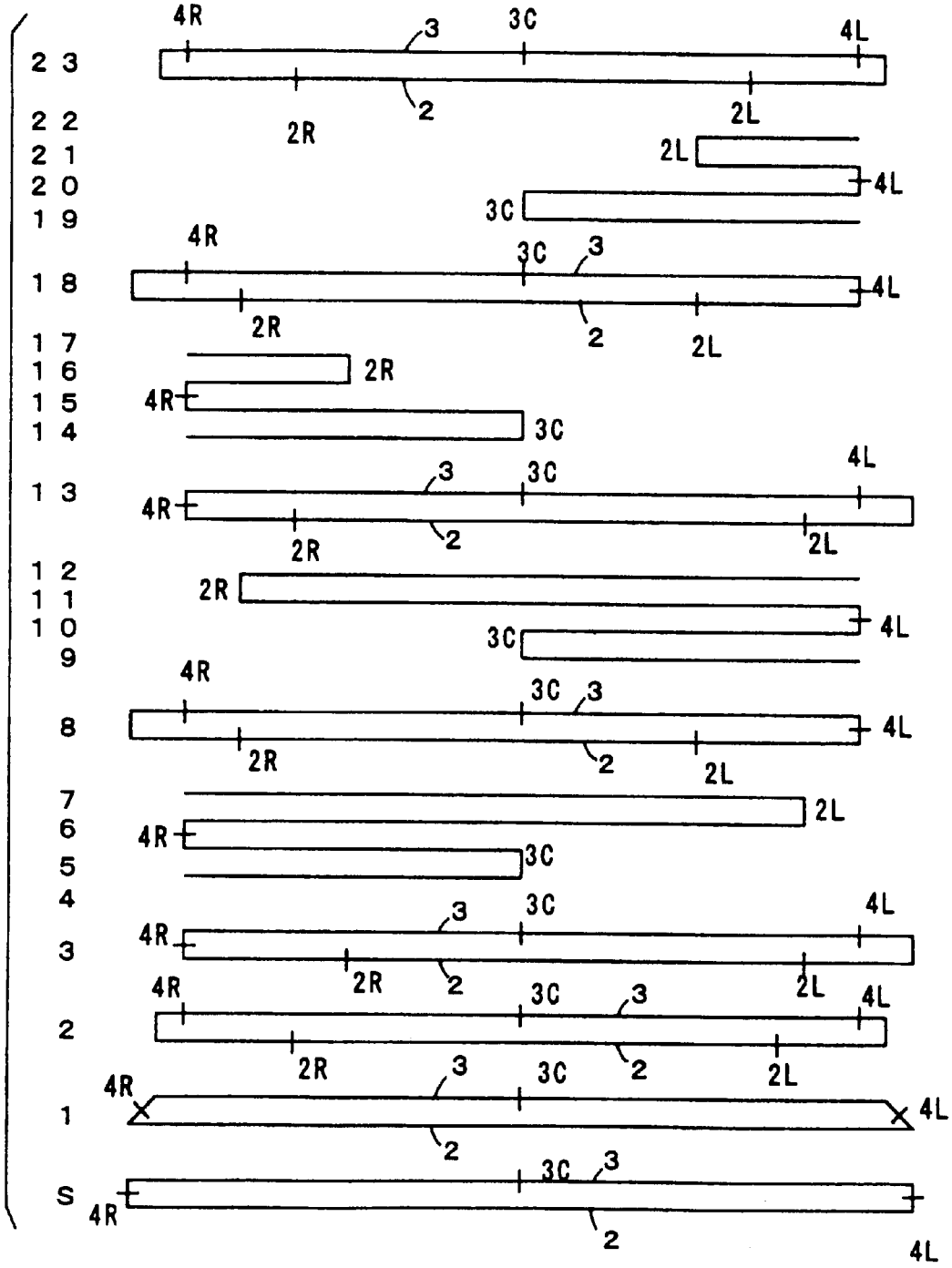
FIG. 3 shows a procedure of knitting in which the number of wales in a back section 3 is decreased in order to form darts 5 by carrying out the yarn sending as shown in FIG. 2A together with the turning of the tubular knitted fabric 1.

FIG. 3 shows the procedure of knitting in which the number of wales in the back section 3 is decreased in order to form the darts 5 by carrying out the yarn sending as shown in FIG. 2A together with the turning of the tubular knitted fabric 1. The number of yarn feeding members for feeding knitting yarns for knitting is two. It should be noted that three or more yarn feeding members also can be used such that during the process described below, one yarn feeding member that is being used is switched to another yarn feeding member. In an S-step, the front section 2 and the back section 3 are knitted at the same knitting width. In a first step, the back section 3 is narrowed by one stitch on both sides of the joint 3C, so that the number of wales is smaller by two than that of the front section 2.

In a second step, narrowing is carried out by one stitch on both sides in the back section 3 as in the first step. Both end portions of the front section 2 are transferred from the front needle bed to the back needle bed, so that the knitted fabrics caught on the front and back needle beds have an equivalent number of wales. Since the difference in the number of wales between the front and back needle beds is one on each side, the front and back needle beds have an equivalent number of wales, by superimposing stitches caught on the knitting needles on both sides on the front needle bed, on stitches caught on the knitting needles on both sides on the back needle bed. In the entire tubular knitted fabric 1, the number of wales decreases by four. As a result, the boundaries 4L and 4R are turned onto the back needle bed.

In a third step, turning is carried out such that the right boundary 4R is positioned between the front and back needle beds. In a fourth step, the right half of the back section 3 is knitted by one course from the boundary 4R to the joint 3C, using the yarn feeding member that is on standby on the left side on the needle beds. In a fifth step, the right half of the back section 3 is knitted by one course in a returning manner from the joint 3C to the boundary 4R. In the fourth step and the fifth step, C-knitting is carried out in which the right half of the back section 3 is knitted by two courses. In a sixth step, the front section 2 is knitted by one course from the boundary 4R to the left joint 2L. In a seventh step, the front section 2 is knitted by one course in a returning manner from the left joint 2L to the boundary 4R. In the sixth step and the seventh step, C-knitting is carried out in which in the front section 2, a portion from the boundary 4R to the left joint 2L is knitted by two courses. When the seventh step has been ended, the yarn feeding member that has fed a knitting yarn for knitting in each course is put on standby on the left side on the needle beds.

In an eighth step, turning is carried out such that the left boundary 4L is positioned between the front and back needle beds. In a ninth step, the left half of the back section 3 is knitted by one course from the boundary 4L to the joint 3C, using the yarn feeding member that is on standby on the right side on the needle beds. In a tenth step, the left half of the back section 3 is knitted by one course in a returning manner from the joint 3C to the boundary 4L. In the ninth step and the tenth step, the left half of the back section 3 is knitted by two courses. In an eleventh step, the front section 2 is knitted by one course from the boundary 4L to the right joint 2R. In a twelfth step, the front section 2 is knitted by one course in a returning manner from the right joint 2R to the boundary 4L. In the eleventh step and the twelfth step, in the front section 2, a portion from the boundary 4L to the right joint 2R is knitted by two courses. When the twelfth step has been ended, the yarn feeding member that has fed a knitting yarn for knitting in each course is put on standby on the right side on the needle beds. It should be noted that in the front section 2, the portion between the left joint 2L and the right joint 2R has been knitted also in the sixth step and the seventh step, and thus this portion is knitted by four courses in total.

In a thirteenth step, turning is carried out such that the right boundary 4R is positioned between the front and back needle beds. In a fourteenth step, the right half of the back section 3 is knitted by one course from the boundary 4R to the joint 3C, using the yarn feeding member that is on standby on the left side on the needle beds. In a fifteenth step, the right half of the back section 3 is knitted by one course in a returning manner from the joint 3C to the boundary 4R. In the fourteenth step and the fifteenth step, the right half of the back section 3 is knitted by two courses. The right half of the back section 3 has been knitted by two courses in the fourth step and the fifth step, and thus this right half is knitted by four courses in total. In a sixteenth step, the front section 2 is knitted by one course from the boundary 4R to the right joint 2R. In a seventeenth step, the front section 2 is knitted by one course in a returning manner from the right joint 2R to the boundary 4R. In the sixteenth step and the seventeenth step, in the front section 2, a portion from the boundary 4R to the right joint 2R is knitted by two courses. In the front section 2, the portion from the boundary 4R to the right joint 2R has been knitted also in the knitting by two courses in the sixth step and the seventh step, and thus this portion is knitted by four courses in total. When the seventeenth step has been ended, the yarn feeding member that has fed a knitting yarn for knitting in each course is put on standby on the left side on the needle beds.

In an eighteenth step, turning is carried out such that the left boundary 4L is positioned between the front and back needle beds. In a nineteenth step, the left half of the back section 3 is knitted by one course from the boundary 4L to the joint 3C, using the yarn feeding member that is on standby on the right side on the needle beds. In a twentieth step, the left half of the back section 3 is knitted by one course in a returning manner from the joint 3C to the boundary 4L. In the nineteenth step and the twentieth step, the left half of the back section 3 is knitted by two courses. The left half of the back section 3 has been knitted also in the ninth step and the tenth step by two courses, and thus this left half is knitted by four courses in total. In a twenty first step, the front section 2 is knitted by one course from the boundary 4L to the left joint 2L. In a twenty second step, the front section 2 is knitted by one course in a returning manner from the left joint 2L to the boundary 4L. In the twenty first step and the twenty second step, in the front section 2, a portion from the boundary 4L to the left joint 2L is knitted by two courses. In the front section 2, the portion from the boundary 4L to the left joint 2L has been knitted also in the knitting by two courses in the eleventh step and the twelfth step, and thus this portion is knitted by four courses in total. When the twenty second step has been ended, the yarn feeding member that has fed a knitting yarn for knitting in each course is put on standby on the right side on the needle beds. In a twenty third step, the tubular knitted fabric is in a state where knitting up to the twenty second step has been ended. The number of stitches in the circumferential direction is the same as that in the second step, and each of the front section 2 and the back section 3 has been knitted by four courses in the fourth to twenty second steps. During the knitting by four courses, the tubular knitted fabric 1 can be obtained in which the number of wales is decreased by two on both sides of the joint 3C in the back section 3, that is, by four in total.

As described above, the number of wales in the back section 3 can be decreased by four in the unit of four courses, by taking the process from the first step to the twenty second step as one cycle, and repeating this cycle in a similar manner.

Herein, during knitting, it is necessary to keep the joint 2R, 2L away from an end portion of a knitted fabric that is caught on the needle bed. For example, when narrowing is repeated, the joint 2R, 2L in the front section 2 moves closer to an end portion of a knitted fabric that is caught on the front needle bed. When the joint 2R, 2L in the front section 2 is kept away from an end portion and is prevented from being turned onto the back needle bed even in a state where the number of wales in the back section 3 is smallest, a joint line can be formed at a position away from the boundaries 4R and 4L by a constant number of stitches, and thus the external appearance can be improved. Also in the case of widening described below, when the joints 2R and 2L are provided in a similar manner, a joint line can be formed on the same wale.

Figure 4:
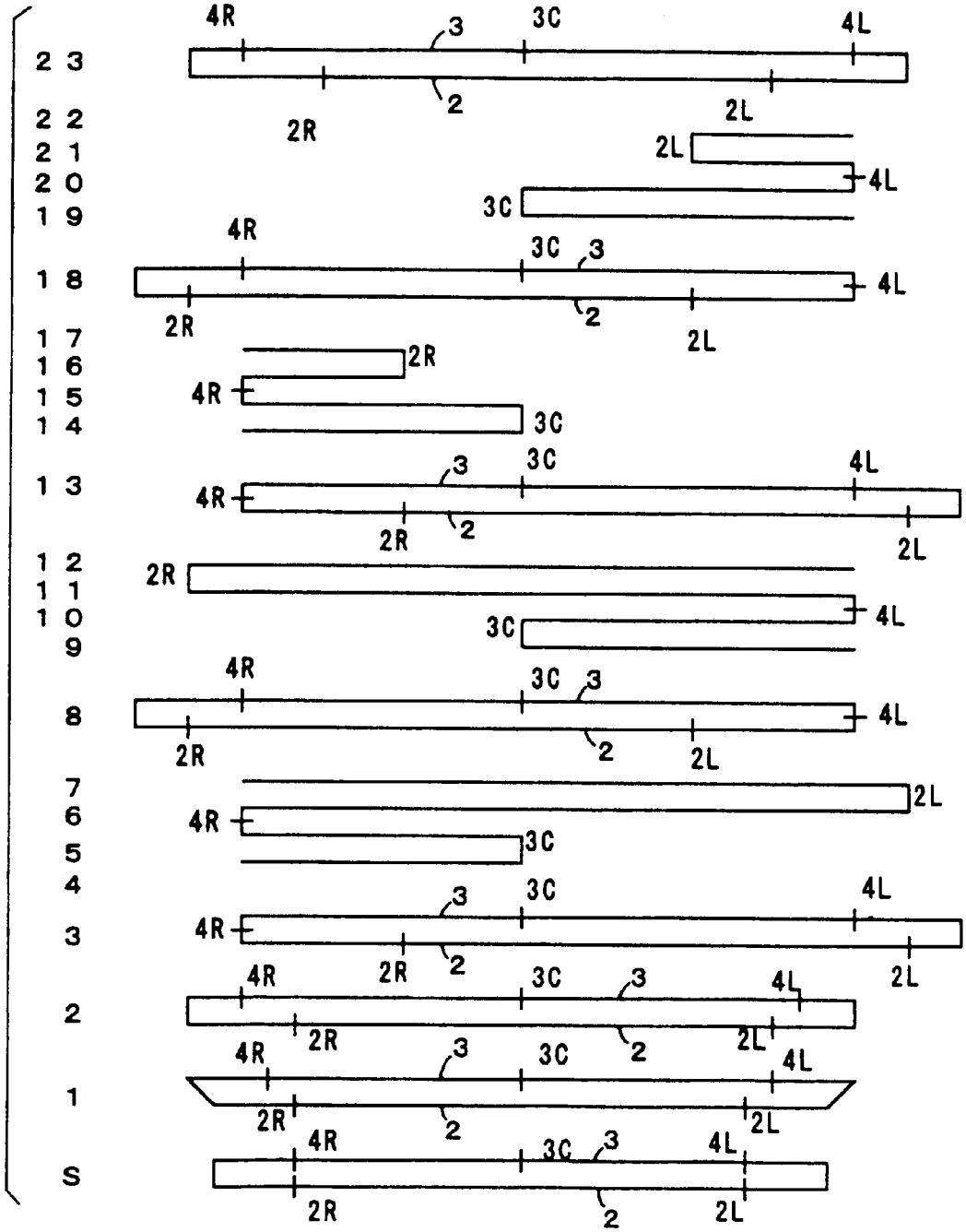
FIG. 4 shows the procedure of knitting in which the number of wales in the back section 3 is increased in order to form the darts 5 by carrying out the yarn sending as shown in FIG. 2A together with the turning of the tubular knitted fabric 1.

FIG. 4 shows the procedure of knitting in which the number of wales in the back section 3 is increased in order to form the darts 5 by carrying out the yarn sending as shown in FIG. 2A together with the turning of the tubular knitted fabric 1. The number of yarn feeding members for feeding knitting yarns for knitting is two. It should be noted that three or more yarn feeding members also can be used such that during the process described below, one yarn feeding member that is being used is switched to another yarn feeding member.

It is assumed that in an S-step, after the twenty third step in FIG. 3, the first to twenty second steps have been repeated for two cycles. For the sake of convenience, the procedure is described for a case in which the number of stitches is increased from the state in the S-step. In the darts 5 as shown in FIG. 1A, the number of wales is increased from the state in which the number of wales in the back section 3 is smallest, but the manner of yarn sending is basically the same.

In a first step, the back section 3 is widened by one stitch on both sides of the central joint 3C, for example, so that the number of wales is larger by two than that of the front section 2. In a second step, widening is carried out by one stitch on both sides of the central joint 3C as in the first step. Both end portions of the back section 3 are transferred from the back needle bed to the front needle bed, so that the knitted fabrics caught on the front and back needle beds have an equivalent number of wales. As a result, the stitches on the back needle bed are turned onto the front needle bed.

In a third step, turning is carried out such that the right boundary 4R is positioned between the front and back needle beds. In a fourth step, the right half of the back section 3 is knitted by one course from the boundary 4R to the central joint 3C, using the yarn feeding member that is on standby on the left side on the needle beds. In a fifth step, the right half of the back section 3 is knitted by one course in a returning manner from the central joint 3C to the boundary 4R. In the fourth step and the fifth step, the right half of the back section 3 is knitted by two courses. In a sixth step, the front section 2 is knitted by one course from the boundary 4R to the left joint 2L. In a seventh step, the front section 2 is knitted by one course in a returning manner from the left joint 2L to the boundary 4R. In the sixth step and the seventh step, in the front section 2, a portion from the boundary 4R to the left joint 2L is knitted by two courses. When the seventh step has been ended, the yarn feeding member that has fed a knitting yarn for knitting in each course is put on standby on the left side on the needle beds.

In an eighth step, turning is carried out such that the left boundary 4L is positioned between the front and back needle beds. In a ninth step, the left half of the back section 3 is knitted by one course from the boundary 4L to the central joint 3C, using the yarn feeding member that is on standby on the right side on the needle beds. In a tenth step, the left half of the back section 3 is knitted by one course in a returning manner from the central joint 3C to the boundary 4L. In the ninth step and the tenth step, the left half of the back section 3 is knitted by two courses. In an eleventh step, the front section 2 is knitted by one course from the boundary 4L to the right joint 2R. In a twelfth step, the front section 2 is knitted by one course in a returning manner from the right joint 2R to the boundary 4L. In the eleventh step and the twelfth step, in the front section 2, a portion from the boundary 4L to the right joint 2R is knitted by two courses. When the twelfth step has been ended, the yarn feeding member that has fed a knitting yarn for knitting in each course is put on standby on the right side on the needle beds. It should be noted that in the front section 2, the portion between the left joint 2L and the right joint 2R has been knitted also in the sixth step and the seventh step, and thus this portion is knitted by four courses in total.

In a thirteenth step, turning is carried out such that the right boundary 4R is positioned between the front and back needle beds. In a fourteenth step, the right half of the back section 3 is knitted by one course from the boundary 4R to the central joint 3C, using the yarn feeding member that is on standby on the left side on the needle beds. In a fifteenth step, the right half of the back section 3 is knitted by one course in a returning manner from the central joint 3C to the boundary 4R. In the fourteenth step and the fifteenth step, the right half of the back section 3 is knitted by two courses. The right half of the back section 3 has been knitted by two courses in the fourth step and the fifth step, and thus this right half is knitted by four courses in total. In a sixteenth step, the front section 2 is knitted by one course from the boundary 4R to the right joint 2R. In a seventeenth step, the front section 2 is knitted by one course in a returning manner from the right joint 2R to the boundary 4R. In the sixteenth step and the seventeenth step, in the front section 2, a portion from the boundary 4R to the right joint 2R is knitted by two courses. In the front section 2, the portion from the boundary 4R to the right joint 2R has been knitted also in the knitting by two courses in the sixth step and the seventh step, and thus this portion is knitted by four courses in total. When the seventeenth step has been ended, the yarn feeding member that has fed a knitting yarn for knitting in each course is put on standby on the left side on the needle beds.

In an eighteenth step, turning is carried out such that the left boundary 4L is positioned between the front and back needle beds. In a nineteenth step, the left half of the back section 3 is knitted by one course from the boundary 4L to the central joint 3C, using the yarn feeding member that is on standby on the right side on the needle beds. In a twentieth step, the left half of the back section 3 is knitted by one course in a returning manner from the central joint 3C to the boundary 4L. In the nineteenth step and the twentieth step, the left half of the back section 3 is knitted by two courses. The left half of the back section 3 has been knitted also in the ninth step and the tenth step by two courses, and thus this left half is knitted by four courses in total. In a twenty first step, the front section 2 is knitted by one course from the boundary 4L to the left joint 2L. In a twenty second step, the front section 2 is knitted by one course in a returning manner from the left joint 2L to the boundary 4L. In the twenty first step and the twenty second step, in the front section 2, a portion from the boundary 4L to the left joint 2L is knitted by two courses. In the front section 2, the portion from the boundary 4L to the left joint 2L has been knitted also in the knitting by two courses in the eleventh step and the twelfth step, and thus this portion is knitted by four courses in total. When the twenty second step has been ended, the yarn feeding member that has fed a knitting yarn for knitting in each course is put on standby on the right side on the needle beds. In a twenty third step, the tubular knitted fabric 1 is in a state where the twenty second step has been completed. The number of stitches in the circumferential direction is the same as that in the second step, and each of the front section 2 and the back section 3 has been knitted by four courses. Through this knitting, the tubular knitted fabric 1 can be obtained in which the number of wales is increased by two on both sides of the central joint 3C in the back section 3, that is, by four in total.

As described above, the number of wales in the back section 3 can be increased, by taking the process from the first step to the twenty second step as one cycle, and repeating this cycle in a similar manner.

It is also possible to knit a tubular knitted fabric that fits a swell of the body such as the breast portion, by forming a swell in the middle portion in the knitting width by increasing and then decreasing the number of wales in accordance with the progress of course knitting in an opposite manner to that of the darts 5 described above. In a case where the number of wales is increased or decreased in accordance with the progress of course knitting in at least one of a knitted fabric having a larger number of wales and a knitted fabric having a smaller number of wales, knitting can be carried out without formation of a twisted stitch, by carrying out C-knitting while carrying out linking in at least the knitted fabric having a larger number of wales.

Figure 5A:
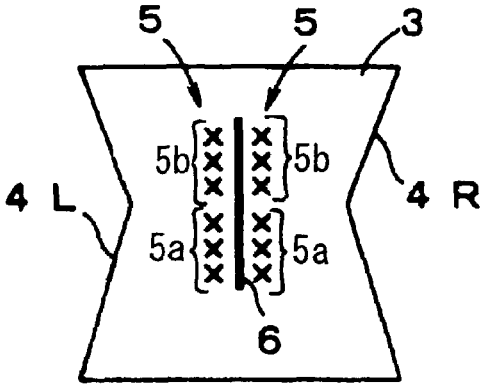
FIGS. 5A and 5B show knitted fabrics of the back section 3 that are knitted by the yarn sending as shown in FIGS. 2A and 2B.
Figure 5B:
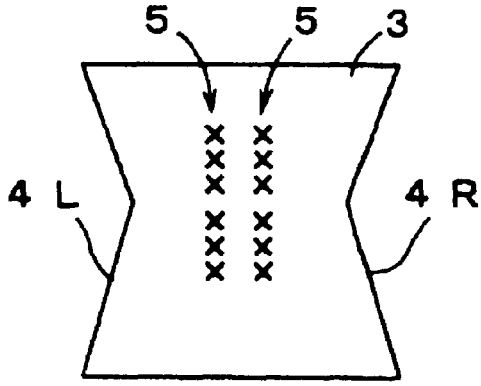

FIGS. 5A and 5B show knitted fabrics of the back section 3 that are knitted by the yarn sending as shown in FIGS. 2A and 2B. FIG. 5A shows a state in which the joint line 6 is formed in the middle between the darts 5 by forming the joint in the center of the back section 3 as shown in FIG. 2A. FIG. 5B shows a state in which joints are formed at positions different from the darts 5 by forming the joints on both sides as shown in FIG. 2B.

Figure 6A:
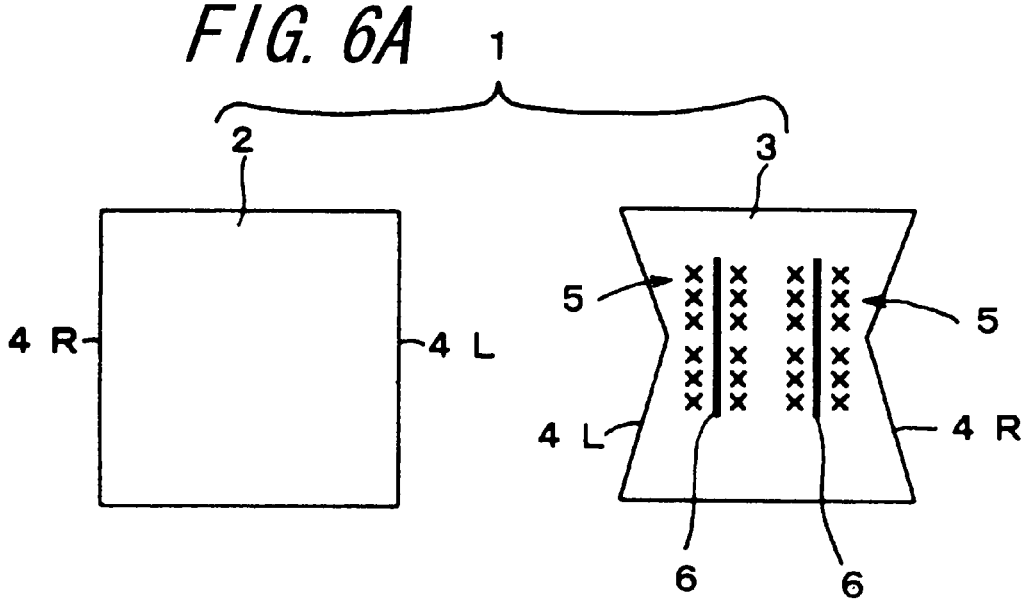
FIGS. 6A and 6B are views showing a shape of the darts 5 in another embodiment of the invention.
Figure 6B:
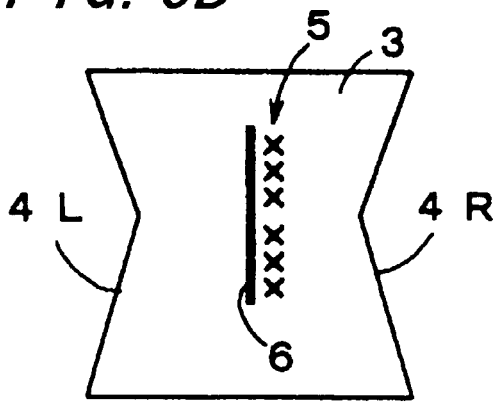

FIGS. 6A and 6B show an example of the positional relationship between the dart 5 and the joint line 6 as another embodiment of the invention. FIG. 6A shows an example in which the darts 5 are formed separately in the left and right in the back section 3, and the joint line 6 is formed in the middle between each pair of the darts 5. This knitting can be carried out by knitting a portion between the joint lines 6 using an independent yarn feeding member. FIG. 6B shows a state in which the dart 5 is formed only on one side of the joint line 6. Not only in a case where the darts 5 and the joint lines 6 are provided symmetrically on the left and right, but also in a case where the dart 5 or the joint line 6 is provided only on the left or right, the tubular knitted fabric 1 having asymmetric front and back sections can be formed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, using a flat knitting machine provided with at least a pair of front and back needle beds, a front knitted fabric belonging to the front needle bed and a back knitted fabric belonging to the back needle bed are knitted such that by turning, a step on one side and a step on the other side are repeatedly carried out in which a continuous portion on one side and a continuous portion on the other side are positioned between the front and back needle beds. The knitted fabric having a larger number of wales is knitted separately in the step on the one side and the step on the other side on the needle bed for knitting stitches of the knitted fabric having a larger number of wales, and is then linked. Thus, the knitted fabric having a larger number of wales can be knitted without formation of a twisted stitch. Asymmetrical knitting in which the number of wales is different between front and back knitted fabrics can be carried out efficiently.

Furthermore, according to the invention, in at least one of the front knitted fabric and the back knitted fabric, a dart is formed in a middle portion in the knitting width by decreasing and then increasing the number of wales in accordance with progress of course knitting. Thus, the dart portion can be constricted. Even when the number of wales changes from course to course, the knitted fabric having a larger number of wales in each course can be knitted by linking in the middle in the knitting width. Thus, knitting can be carried out efficiently without formation of a twisted stitch.

Furthermore, according to the invention, in a knitted fabric in which a dart is formed, a position at which linking is carried out midway through the knitting width is provided in the middle between lines, in each of which a narrowing line is continued to a widening line of the dart in each knitted fabric that is to be linked. Thus, it is possible to improve the external appearance of a line constituted by the joint of the knitted fabric.

Furthermore, according to the invention, in at least one of the front knitted fabric and the back knitted fabric, a swell is formed in a middle portion in the knitting width by increasing and then decreasing the number of wales in accordance with progress of course knitting. Thus, it is possible to knit a tubular knitted fabric that fits a swell of the body such as the breast portion. Even when the number of wales changes from course to course, the knitted fabric having a larger number of wales in each course can be knitted by carrying out linking in the middle in the knitting width. Thus, knitting can be carried out efficiently without formation of a twisted stitch.

Furthermore, according to the invention, in at least one of the front knitted fabric and the back knitted fabric, the number of wales is increased or decreased in accordance with progress of course knitting. Thus, it is possible to seamlessly knit a tubular knitted fabric in which the difference in the number of wales between knitted fabrics is increased or decreased. Even when the number of wales changes from course to course, the knitted fabric having a larger number of wales in each course can be knitted by carrying out linking in the middle in the knitting width. Thus, knitting can be carried out efficiently without formation of a twisted stitch.

Furthermore, according to the invention, the joint is formed on the same wale. Thus, it is possible to improve the appearance.

The invention claimed is:

1. A method of knitting a tubular knitted fabric using a flat knitting machine provided with at least a pair of front and back needle beds such that a front knitted fabric belonging to the front needle bed and a back knitted fabric belonging to the back needle bed are continuously formed on both sides in a knitting width and such that the number of wales is different between the front knitted fabric and the back knitted fabric, comprising:

a step on one side of carrying out turning such that the knitted fabrics caught on the needle beds on both sides have an equivalent number of wales, in which between continuous portions between a knitted fabric having a larger number of wales and a knitted fabric having a smaller number of wales, the continuous portion on one side in the knitting width is positioned between the pair of front and back needle beds, the needle bed to which the knitted fabric having a smaller number of wales belongs catches the knitted fabric having a smaller number of wales, the continuous portion on the other side, and an end portion of the knitted fabric having a larger number of wales, and the needle bed to which the knitted fabric having a larger number of wales belongs catches the knitted fabric having a larger number of wales except for the end portion; and a step on the other side of carrying out turning such that the knitted fabrics caught on the needle beds on both sides have an equivalent number of wales, in which between the continuous portions between the knitted fabric having a larger number of wales and the knitted fabric having a smaller number of wales, the continuous portion on the other side in the knitting width is positioned between the pair of front and back needle beds, the needle bed to which the knitted fabric having a smaller number of wales belongs catches the knitted fabric having a smaller number of wales, the continuous portion on the one side, and an end portion of the knitted fabric having a larger number of wales, and the needle bed to which the knitted fabric having a larger number of wales belongs catches the knitted fabric having a larger number of wales except for the end portion, wherein the step on the one side and the step on the other side are alternately repeated, the knitted fabric having a larger number of wales is provided with a joint, within a range in which the joint is caught on the knitted fabric having a larger number of wales in both of the step on the one side and the step on the other side, in the step on the one side, in the knitted fabric having a larger number of wales, a portion on the one side from the continuous portion on the one side to the joint is knitted, in the step on the other side, in the knitted fabric having a larger number of wales, a portion on the other side from the continuous portion on the other side to the joint is knitted, and the portion on the one side and the portion on the other side in the knitted fabric having a larger number of wales are linked to each other at the joint.

2. The method of knitting the tubular knitted fabric of claim 1, wherein in at least one of the front knitted fabric and the back knitted fabric, a dart is formed in a middle portion in the knitting width by decreasing and then increasing the number of wales in accordance with progress of course knitting.

3. The method of knitting the tubular knitted fabric of claim 2, wherein even when the knitted fabric in which the dart is formed is the knitted fabric having a smaller number of wales, the knitted fabric is knitted separately in the step on the one side and the step on the other side, and linking is carried out at the joint, the joint is formed so as to be positioned on the same straight line in a wale direction, and in each of the portion on the one side and the portion on the other side in the knitted fabric, a line in which a narrowing line is continued to a widening line of the dart is formed at the same interval from a line constituted by the joint.

4. The method of knitting the tubular knitted fabric of claim 1, wherein in at least one of the front knitted fabric and the back knitted fabric, a swell is formed in a middle portion in the knitting width by increasing and then decreasing the number of wales in accordance with progress of course knitting.

5. The method of knitting the tubular knitted fabric of claim 1, wherein in at least one of the front knitted fabric and the back knitted fabric, the number of wales is increased or decreased in accordance with progress of course knitting.

6. The method of knitting the tubular knitted fabric of claim 1, wherein the joint provided in the knitted fabric having a larger number of wales is knitted so as to be positioned on the same wale such that the joint is spaced away from the continuous portions between the front knitted fabric and the back knitted fabric, within a range of the knitting width in which the joint is caught on the same needle bed in both of the step on the one side and the step on the other side.

7. The method of knitting the tubular knitted fabric of claim 2, wherein the joint provided in the knitted fabric having a larger number of wales is knitted so as to be positioned on the same wale such that the joint is spaced away from the continuous portions between the front knitted fabric and the back knitted fabric, within a range of the knitting width in which the joint is caught on the same needle bed in both of the step on the one side and the step on the other side.

8. The method of knitting the tubular knitted fabric of claim 3, wherein the joint provided in the knitted fabric having a larger number of wales is knitted so as to be positioned on the same wale such that the joint is spaced away from the continuous portions between the front knitted fabric and the back knitted fabric, within a range of the knitting width in which the joint is caught on the same needle bed in both of the step on the one side and the step on the other side.

9. The method of knitting the tubular knitted fabric of claim 4, wherein the joint provided in the knitted fabric having a larger number of wales is knitted so as to be positioned on the same wale such that the joint is spaced away from the continuous portions between the front knitted fabric and the back knitted fabric, within a range of the knitting width in which the joint is caught on the same needle bed in both of the step on the one side and the step on the other side.

10. The method of knitting the tubular knitted fabric of claim 5, wherein the joint provided in the knitted fabric having a larger number of wales is knitted so as to be positioned on the same wale such that the joint is spaced away from the continuous portions between the front knitted fabric and the back knitted fabric, within a range of the knitting width in which the joint is caught on the same needle bed in both of the step on the one side and the step on the other side.

* * * * *